US007100545B2

(12) United States Patent
Maassen et al.

(10) Patent No.: US 7,100,545 B2
(45) Date of Patent: Sep. 5, 2006

(54) CYLINDER HEAD FOR A WATER-COOLED INTERNAL COMBUSTION PISTON ENGINE HAVING INNER REINFORCEMENT

(75) Inventors: Franz Maassen, Übach-Palenberg (DE); Ralf Gruner, Köln (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 11/113,309

(22) Filed: Apr. 25, 2005

(65) Prior Publication Data

US 2005/0229875 A1 Oct. 20, 2005

Related U.S. Application Data

(63) Continuation of application No. PCT/EP03/10072, filed on Sep. 11, 2003.

(30) Foreign Application Priority Data

Oct. 25, 2002 (DE) ..... 202 16 452 U

(51) Int. Cl.
*F02F 1/36* (2006.01)

(52) U.S. Cl. ..... 123/41.82 R

(58) Field of Classification Search ..... 123/41.82 R
See application file for complete search history.

(56) References Cited

U.S. PATENT DOCUMENTS 1,750,729 A 3/1930 Ruegg
3,315,652 A * 4/1967 Ries et al. ..... 123/41.82 R
4,083,333 A * 4/1978 Rudert et al. ..... 123/41.82 R
4,889,080 A 12/1989 Orguri
4,957,068 A 9/1990 Wagner et al.

FOREIGN PATENT DOCUMENTS

DE 42 22 801 1/1994

OTHER PUBLICATIONS

Patent Abstracts of Japan, vol. 0183, No. 23 (M-1624) dated Jun. 20, 1994 (for JP 6 074043 A published Mar. 15, 1994).
Patent Abstracts of Japan, vol. 0183, No. 23 (M-1624) dated Jun. 20, 1994 (for JP 6 074042 A published Mar. 15, 1994).

* cited by examiner

*Primary Examiner*—Noah P. Kamen
(74) *Attorney, Agent, or Firm*—Venable LLP; Robert Kinberg; Steven J. Schwarz

(57) ABSTRACT

A cylinder head for a water-cooled, multi-cylinder piston internal combustion engine comprises a lower wall and an upper wall enclosing a cavity. A well extends into the cavity for receiving a fuel injector and/or an ignition device. An intake port and/or an exhaust port extends through the cavity. A cooling-water carrying region comprises areas of the cavity surrounding the well, intake port, and exhaust port. Portions of the cooling-water carrying region are provided with an intermediate web for reinforcing the cylinder head.

14 Claims, 6 Drawing Sheets

CYLINDER HEAD FOR A WATER-COOLED INTERNAL COMBUSTION PISTON ENGINE HAVING INNER REINFORCEMENT

CROSS-REFERENCE TO RELATED APPLICATIONS

This is a continuation of International Patent Application No. PCT/EP003/010072, filed Sep. 11, 2003, designating the United States and claiming priority of German Patent Application No. 202 16 452.7, filed Oct. 25, 2002, the priority of which is claimed by the present invention. The disclosures of both of the foregoing applications are hereby incorporated herein by reference in their entirety.

BACKGROUND OF THE INVENTION

Due to the desire to further increase the performance of piston internal combustion engines, whether operating on the Otto cycle or the diesel cycle, there is a desire to save weight, which leads to the use of materials such as aluminum, as well as a desire to improve performance, which leads to an increase in pressures within the cylinder. However, the increase in pressures within the cylinder causes considerable mechanical stress for the cylinder head. In particular, there is an alternating bending load on the cylinder head, which results in the risk of cracks developing in the cylinder head.

German patent document DE-C-42 22 801 discloses a cylinder head for a piston internal combustion engine, where the cooling-water carrying regions of the cylinder head, enclosed by a lower wall and an upper wall, are divided continuously by an intermediate wall into a lower cooling-water carrying region delimited by the lower wall, and an upper cooling-water carrying region delimited by the upper wall. The lower and the upper cooling-water carrying regions in this case do not contain any transverse connections for a cooling-water exchange between the lower and the upper regions, such that completely separate cooling-water flows are guided across the cylinder head. The continuous intermediate wall of this design reinforces the cylinder head with respect to the aforementioned bending loads caused by the increased pressures inside the cylinder. However, producing a cylinder head of this type can pose problems with respect to casting technology. In addition, the completely separate guidance of cooling-water inside the cylinder head can result in disadvantageous heat stresses within the cylinder head, because of the temperature differences that can result from a lack of transverse cooling-water exchange between the hotter lower cooling-water carrying region and the relatively cooler upper cooling-water carrying region.

SUMMARY OF THE INVENTION

It is therefore an object of the present invention to create a cylinder head that combines high structural rigidity with substantially uniform cooling from the cooling-water guided through it.

The above and other objects are accomplished according to the present invention with a cylinder head for a water-cooled, multi-cylinder piston internal combustion engine, the cylinder head comprising: a lower wall and an upper wall enclosing a cavity; a well extending into the cavity for receiving at least one of a fuel injector or an ignition device; an intake port extending through the cavity; an exhaust port extending through the cavity; and a cooling-water carrying region comprising areas of the cavity surrounding the well, intake port, and exhaust port, wherein portions of the cooling-water carrying region are provided with an intermediate web for reinforcing the cylinder head.

According to one aspect of the invention, the individual intermediate webs can be arranged at a sufficient distance from one another to provide sufficiently large openings between the lower and upper cooling-water carrying regions to permit a good exchange between the cooling-water flowing near the lower wall and the cooling-water flowing near the upper wall.

According to another aspect of the invention, the intermediate webs can have a substantially planar design and are positioned with their larger surface area aligned substantially parallel to the lower wall. The advantage of this design is that the intermediate webs can be relatively thin. Given a sufficient length and a large enough cross section, the webs can provide the desired rigidity and reinforcement, while ensuring that the flow resistance is kept low. A further advantage is that the intermediate webs, if attached in the region of the intake ports and the exhaust ports, can increase the cooling surface for the exhaust ports and/or can result in a slight heat transfer from the exhaust ports to the intake ports. With respect to the flow direction of the cooling-water in the cylinder head, the front and/or rear edges of one or more of the intermediate webs can be configured to function as guides, for example if given a corresponding shape and/or location, to direct more cooling-water to regions with higher thermal stress, for example, the lower wall.

According to another exemplary embodiment, a cylinder head for a water cooled, multi-cylinder piston internal combustion engine comprises: an upper wall; a lower wall opposite the upper wall; a cooling-water carrying region bound by the upper wall and the lower wall; an intake port projecting from the lower wall into the cooling-water carrying region; an exhaust port projecting from the lower wall into the cooling-water carrying region; and an intermediate web for reinforcing the cylinder head; wherein the intermediate web is substantially planar and divides the cooling-water carrying region into an upper region and a lower region, and the intermediate web allows for exchange between cooling water flowing through the upper region and cooling water flowing through the lower region.

BRIEF DESCRIPTION OF THE DRAWINGS

These and other features and advantages of the invention will be further understood from the following detailed description considered in conjunction with the accompanying drawings, which disclose exemplary embodiments of the invention.

DETAILED DESCRIPTION OF THE INVENTION

Figure 1:
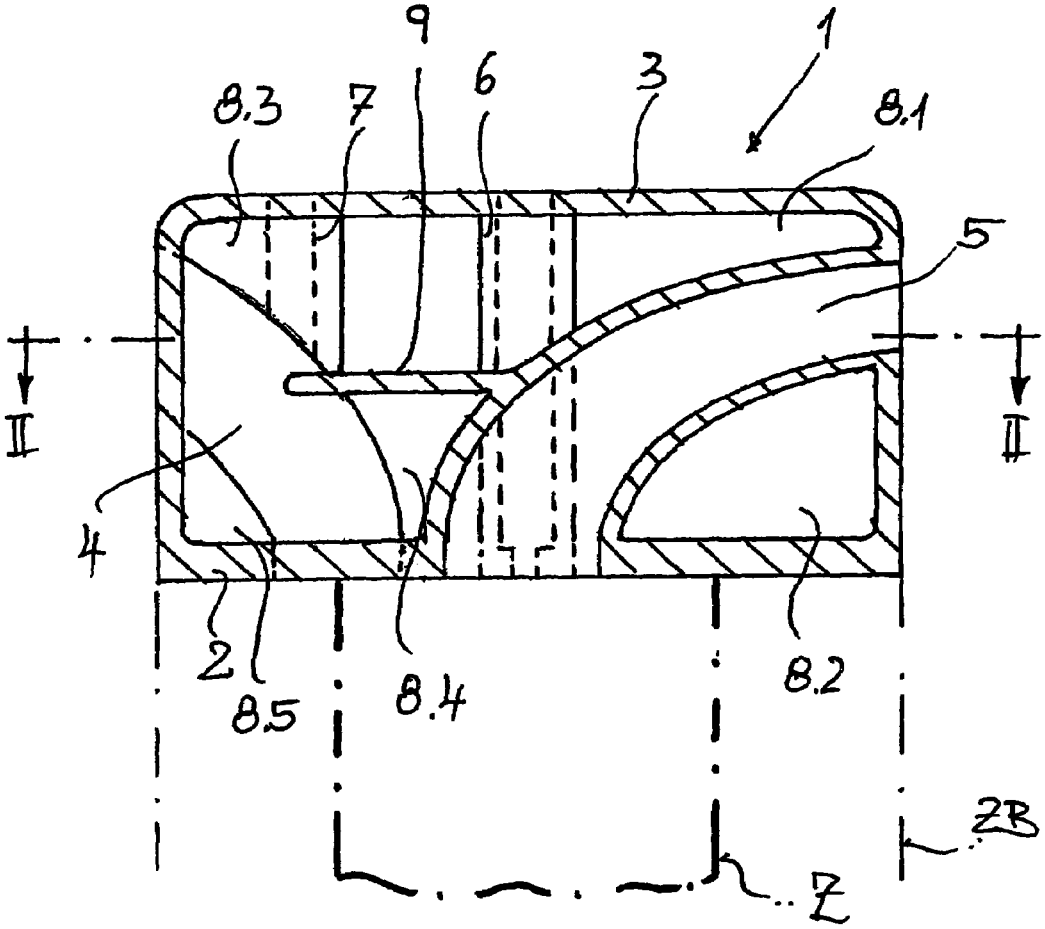
FIG. 1 is a vertical cross-section through an exemplary cylinder head according to the present invention, shown along the line I—I in FIG. 2.

Referring to FIG. 1, there is shown a cross-sectional view of an exemplary cylinder head 1 for a multi-cylinder piston internal combustion engine operating on the diesel cycle. Cylinder head 1 includes a fire deck, or lower wall 2, and an upper deck, or upper wall 3, that jointly enclose a cavity through which cooling-water flows. The cavity is connected to a cooling-water inlet and a cooling-water outlet, not shown in detail herein. The lower wall 2 closes off the top of a cylinder block, represented as ZB, that contains one or more cylinders Z. In each of the respective cylinder regions, the cavity contains at least one gas intake port 4 and at least one gas exhaust port 5, as well as a well 6 for a fuel injector and one or more boreholes 7 for the cylinder head screws. A cylinder head for a piston internal combustion engine operating based on the Otto cycle will have a similar design, except for differences apparent to one of ordinary skill in the art (for example, well 6 will accept a spark plug instead of a fuel injector).

The remaining regions 8.1, 8.2, 8.3, 8.4 and 8.5 between the lower wall 2 and the upper wall 3 serve as cooling-water guides, wherein cooling-water can flow in a longitudinal or transverse direction through these areas, depending on the connection to the cooling-water inlet and the cooling-water outlet.

Figure 2:
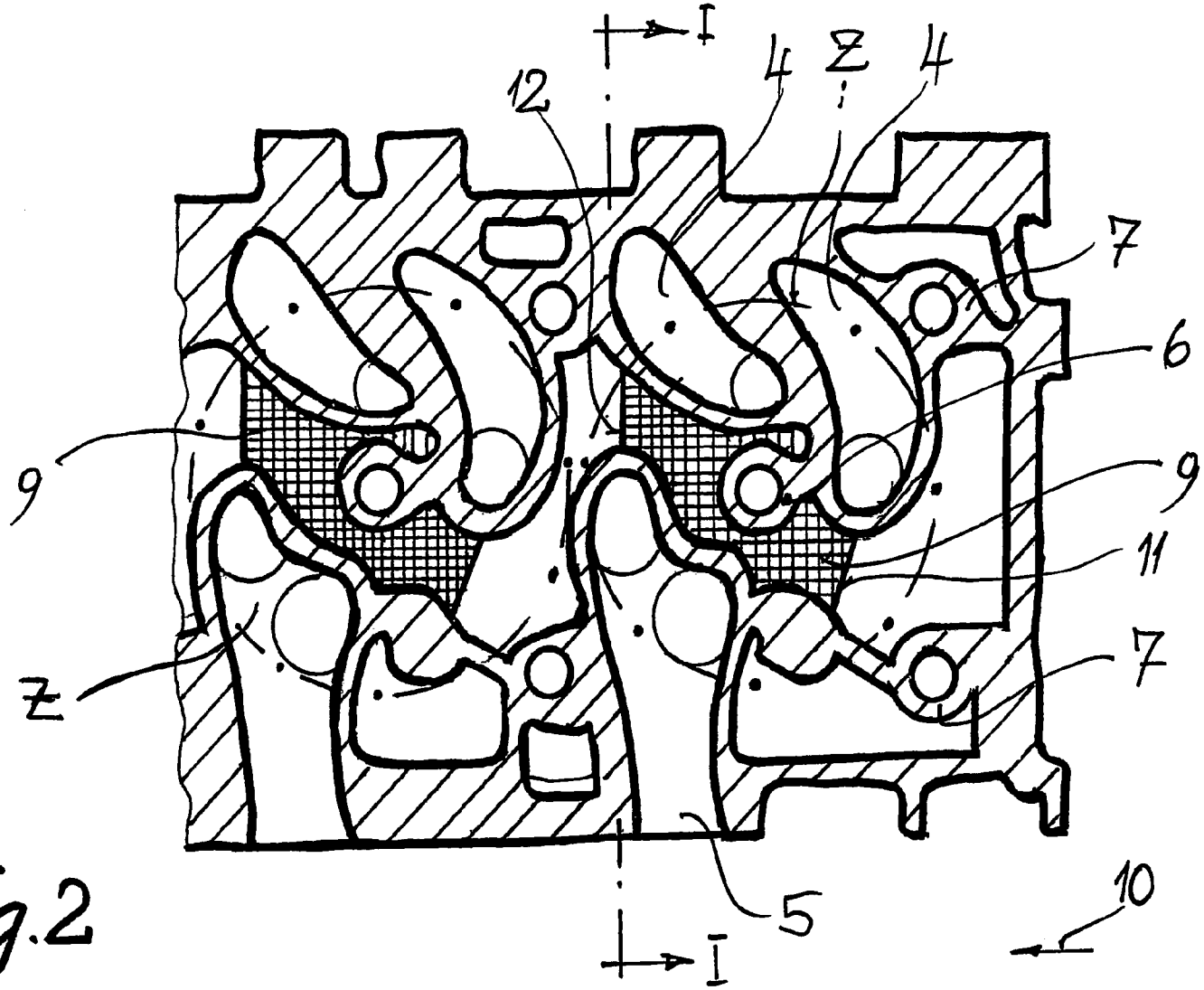
FIG. 2 is a horizontal cross-section through a portion of the cylinder head, shown along the line II—II in FIG. 1.

The top, cross-sectional view of FIG. 2 shows how intermediate webs 9 are respectively arranged in a portion of the water-carrying regions. The surface of the intermediate webs is emphasized in FIGS. 2 and 3 with cross-hatching for clarity. The intermediate webs 9 extend approximately parallel to the lower wall 2. In the exemplary embodiment shown in FIG. 2, the intermediate webs 9 each extend between the intake ports 4 and the exhaust ports 5, thus reinforcing the region directly above the cylinders Z, which are indicated by dash-dot lines.

Figure 3:
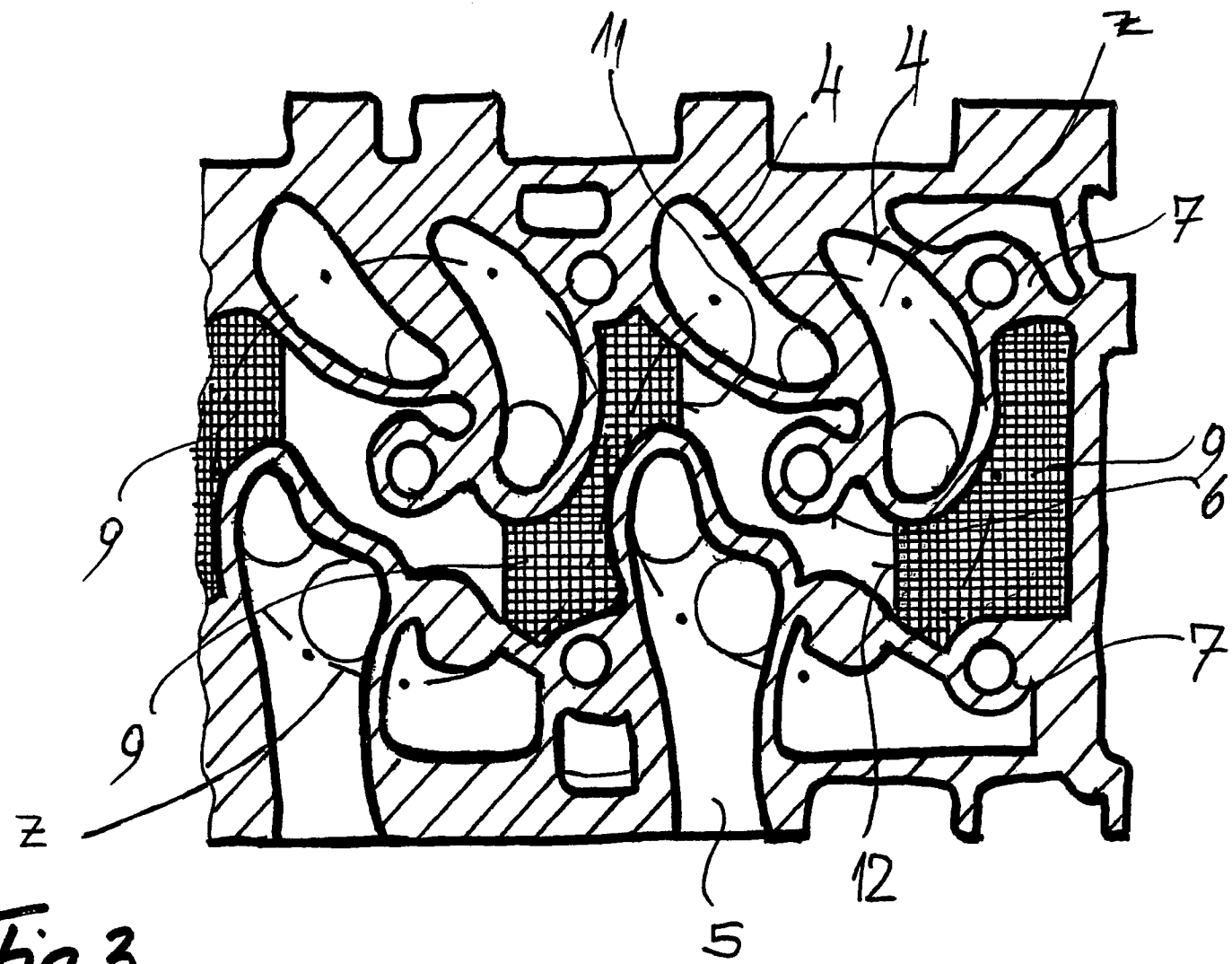
FIG. 3 is a horizontal cross-section according to FIG. 2, showing an alternative arrangement for the intermediate webs.

FIG. 3 is a top, cross-sectional view, similar to FIG. 2, of an alternative embodiment where each of the intermediate webs 9 is provided in the area between two adjacent cylinders Z.

Referring to FIGS. 2 and 3, depending on the position of the intermediate webs 9 within the cylinder head, the front edge 11 and/or the rear edge 12 of the intermediate webs 9 can be designed to function as guiding surfaces, relative to the flow direction, to purposefully direct cooling-water to a desired location, for example, toward the lower wall regions with high thermal stress. Additionally or alternatively, the guiding surfaces can be used to effect an exchange of cooling-water between the flow regions close to the lower wall and the flow regions near the upper wall.

Figure 4:
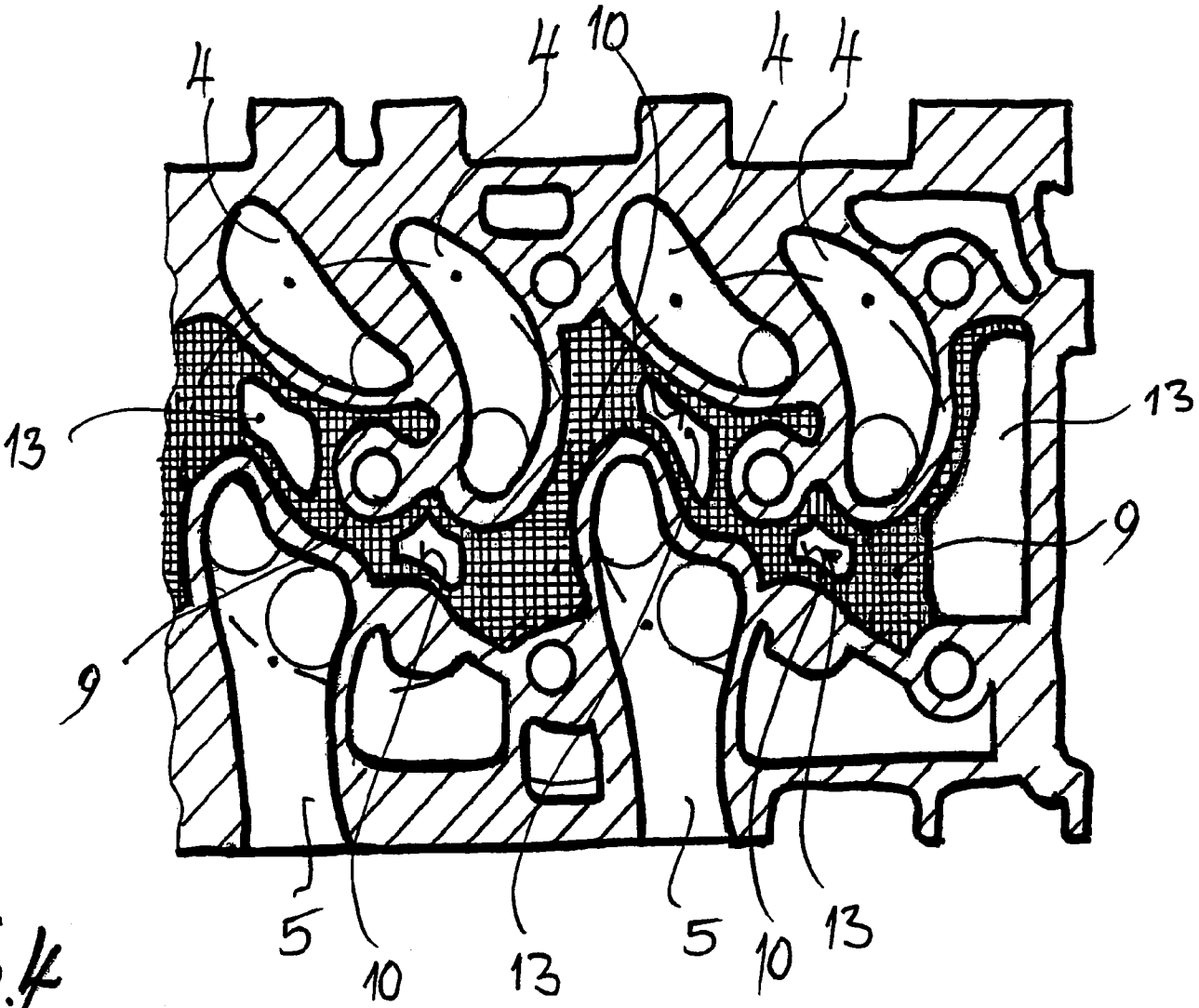
FIG. 4 is a horizontal cross-section according to FIG. 2, showing another alternative arrangement for the intermediate webs.

Referring to FIG. 4, an alternative embodiment of the cylinder head is shown which includes reinforcing ribs 10. Reinforcing ribs 10 are partial ribs that extend in substantially the same plane as the intermediate webs 9, and extend along at least a portion of the walls delimiting the cavity through which the cooling-water flows. The reinforcing ribs 10 only extend partially from one wall to the other, thereby defining openings 13 between adjacent intermediate webs 9, through which an exchange may take place between cooling-water flowing above the intermediate webs 9 and cooling-water flowing beneath them. It may be preferable for the reinforcing ribs 10 to transition into the intermediate webs 9, as shown.

The cylinder head of a multi-cylinder internal combustion engine is subjected to very complex mechanical stresses. For example, in addition to tensile loads/compression stresses, the cylinder head is also subjected to bending/alternating stresses along the transverse motor axis and the longitudinal motor axis. For that reason, the reinforcing ribs 10, which delimit the openings 13, substantially reinforce the walls defining the cavity, for example the walls delimiting the inlet ports and the exhaust ports.

Figure 5:
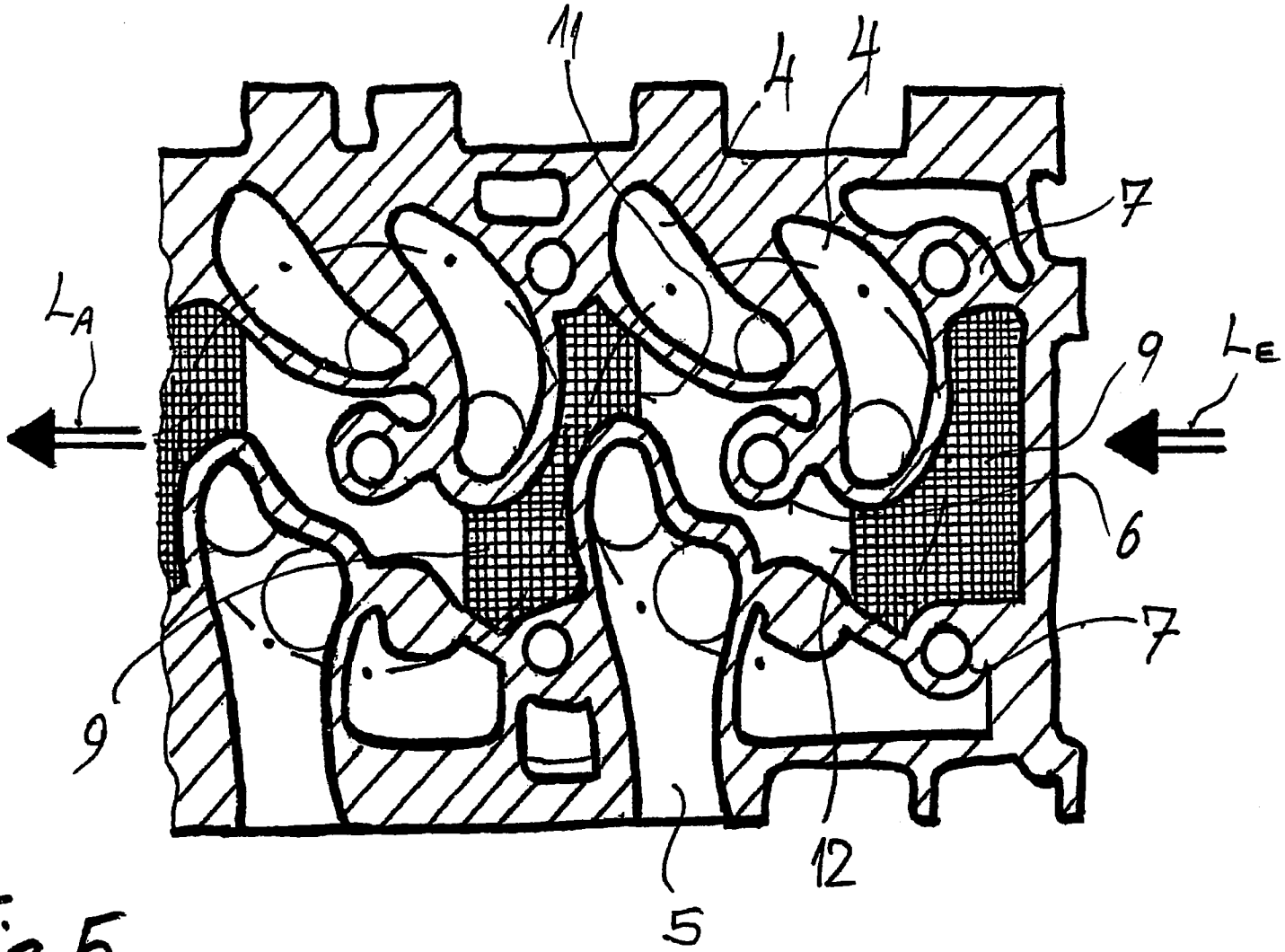
FIG. 5 is the exemplary embodiment of FIG. 3, showing cooling-water flow in a longitudinal direction.

FIG. 5 illustrates cooling-water flow in the longitudinal direction through the exemplary cylinder head of FIG. 3. The arrow $L_E$ indicates that the cooling-water enters the cylinder head on one side and is discharged again on the opposite side, as indicated by arrow $L_A$, so that the cooling-water flows in the longitudinal direction through the cylinder head. The cooling-water flows through the intermediate webs 9 on the side facing the upper wall as well as on the side facing the lower wall. A cooling-water exchange then takes place between the lower wall side and the upper wall side in the open regions located between two successively arranged intermediate webs 9.

Figure 6:
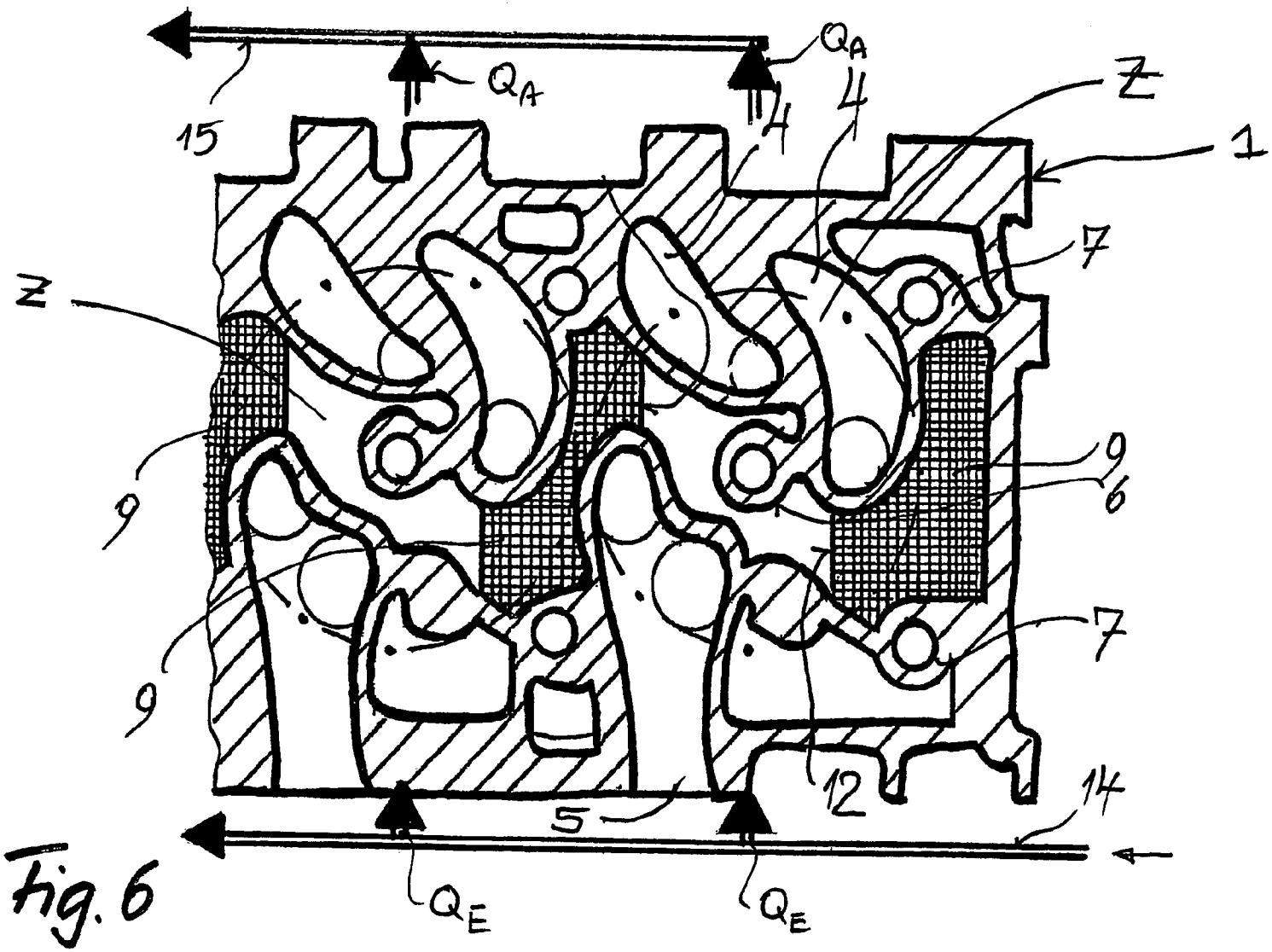
FIG. 6 is the exemplary embodiment of FIG. 3, showing cooling-water flow in a transverse direction.

FIG. 6 illustrates cooling-water flow in the transverse direction through the exemplary cylinder head 1 of FIG. 3. The arrows $Q_E$ indicate that cooling-water flows from a longitudinal feed channel 14, on the side of the exhaust ports 5, into the cooling-water carrying regions respectively assigned to each cylinder Z, in a direction transverse to the longitudinal direction of the cylinder head 1. The longitudinal feed channel 14 may be integrated into the cylinder head 1 or the engine block. The cooling-water flow is indicated schematically with the arrows $Q_E$. The precise position of an individual cylinder depends on the structural conditions, for example, the design of the exhaust ports 5 and the intake ports 4.

Still referring to FIG. 6, a collection channel 15 is provided on the side of the intake ports 4 for the discharge of cooling-water flowing out of the cooling-water regions, as indicated schematically by arrows $Q_A$. The actual position of the collection channel 15 is again based on the existing structural conditions.

A cooling-water exchange can also take place for the transverse flow via the open spaces between adjacent intermediate webs 9.

Cylinder heads typically do not have any bulkhead walls separating the regions associated with each individual cylinder, thus usually allowing the transverse flow to adjust freely to circumvent components oriented in the longitudinal direction, which might otherwise obstruct flow.

The above-described longitudinal and transverse flows are not limited to the exemplary embodiment of FIG. 3, and can be implemented in the same way for the exemplary embodiments shown in FIGS. 1, 2, and 4.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A cylinder head for a water-cooled, multi-cylinder piston internal combustion engine, the cylinder head comprising:

a lower wall and an upper wall enclosing a cavity;

a well extending into the cavity for receiving at least one of a fuel injector or an ignition device;

an intake port extending through the cavity;

an exhaust port extending through the cavity; and a cooling-water carrying region comprising areas of the cavity surrounding the well, intake port, and exhaust port, wherein portions of the cooling-water carrying region are provided with an intermediate web for reinforcing the cylinder head, wherein the intermediate web is substantially planar and extends between the intake port and the exhaust port.

2. The cylinder head of claim 1, wherein the intermediate web is substantially planar and oriented substantially parallel to the lower wall.

3. The cylinder head of claim 1, wherein the intermediate web has a guiding surface configured to direct cooling-water toward the upper wall or the lower wall.

4. The cylinder head of claim 3, wherein the intermediate web has a front edge with respect to a flow of cooling water, and the guiding surface is provided on the front edge.

5. The cylinder head of claim 3, wherein the intermediate web has a rear edge with respect to a flow of cooling water, and the guiding surface is provided on the rear edge.

6. The cylinder head of claim 1, further comprising a reinforcing rib that is substantially coplanar with the intermediate web, wherein the reinforcing rib defines openings that permit exchange between cooling-water flowing adjacent the upper wall and cooling-water flowing adjacent the lower wall.

7. The cylinder head of claim 6, wherein the reinforcing rib transitions into the intermediate web.

8. A cylinder head for a water-cooled, multi-cylinder piston internal combustion engine, the cylinder head comprising:

a lower wall and an upper wall enclosing a cavity;

a well extending into the cavity for receiving at least one of a fuel injector or an ignition device;

an intake port extending through the cavity;

an exhaust port extending through the cavity; and a cooling-water carrying region comprising areas of the cavity surrounding the well, intake port, and exhaust port, wherein portions of the cooling-water carrying region are provided with an intermediate web for reinforcing the cylinder head, wherein the intermediate web includes at least two adjacent intermediate webs with an open region located between the adjacent intermediate webs, wherein the adjacent intermediate webs divide the cooling-water carrying region into an upper region between the upper wall and the adjacent intermediate webs, and a lower region between the lower wall and the adjacent intermediate webs, and the open region permits exchange between cooling-water flowing in the upper region and cooling-water flowing in the lower region.

9. A cylinder head for a water cooled, multi-cylinder piston internal combustion engine, comprising:

an upper wall;

a lower wall opposite the upper wall;

a cooling-water carrying region bound by the upper wall and the lower wall;

an intake port projecting from the lower wall into the cooling-water carrying region;

an exhaust port projecting from the lower wall into the cooling-water carrying region; and two or more intermediate webs integral to the cylinder head for reinforcing the cylinder head, the intermediate webs oriented substantially parallel to the lower wall;

wherein the intermediate webs are substantially planar and divide the cooling-water carrying region into an upper region and a lower region, and the cooling-water carrying region is adapted to pass cooling water through the cylinder head substantially parallel to the intermediate webs in at least one of a longitudinal direction or a transverse direction, and each intermediate web includes an orifice oriented substantially parallel to the lower wall, the orifice allowing for exchange between cooling water flowing through the upper region and cooling water flowing through the lower region.

10. The cylinder head of claim 9, wherein at least one of the intermediate webs has a guiding surface configured to direct cooling-water toward the upper wall or the lower wall.

11. The cylinder head of claim 10, wherein at least one of the intermediate webs has a front edge with respect to the flow of cooling water, and the guiding surface is provided on the front edge.

12. The cylinder head of claim 10, wherein at least one of the intermediate webs has a rear edge with respect to the flow of cooling water, and the guiding surface is provided on the rear edge.

13. The cylinder head of claim 9, further comprising at least one reinforcing rib that is substantially coplanar with the intermediate ribs, wherein the reinforcing rib defines openings that permit exchange between cooling-water flowing adjacent the upper wall and cooling-water flowing adjacent the lower wall.

14. The cylinder head of claim 13, wherein the reinforcing rib transitions into the intermediate webs.

* * * * *